United States Patent [19]

Manizza

[11] 4,029,204

[45] June 14, 1977

[54] BOTTLE PACKAGE

[75] Inventor: Guelfo A. Manizza, Blauvelt, N.Y.

[73] Assignee: Federal Paper Board Company, Inc., Montvale, N.J.

[22] Filed: June 23, 1975

[21] Appl. No.: 589,242

[52] U.S. Cl. ..... 206/140; 206/434; 229/40

[51] Int. Cl.[2] ..... B65D 65/12; B65D 85/30

[58] Field of Search ..... 206/157, 180, 182, 185, 206/193–194, 196, 427, 434; 229/15, 27, 28 BC, 40, 42

[56] References Cited

UNITED STATES PATENTS

| | | | |
|---|---|---|---|
| 3,283,990 | 11/1966 | Tolaas | 229/40 |
| 3,347,366 | 10/1967 | DePaul | 206/157 X |
| 3,424,368 | 1/1969 | Forrer | 229/40 |
| 3,640,448 | 2/1972 | Wood | 229/40 |
| 3,680,765 | 8/1972 | Harrelson | 229/40 |

*Primary Examiner*—Steven E. Lipman
*Attorney, Agent, or Firm*—Guy A. Greenawalt

[57] ABSTRACT

A wraparound type carrier package for a group of bottles arranged in double row relation and transversely aligned pairs, which package is especially adapted for use in the marketing of bottled beverages and which is designed to satisfy railway requirements for shipping containers or packages of this type with respect to bottle separation, the package being formed from a flat blank of paperboard or similar foldable sheet material which is cut and scored so that it may be wrapped about the top and bottom of two rows of bottles and the ends of the blank overlapped and connected by cooperating interengaging locking elements, with one margin having an extension panel cut therein which is folded upwardly to a bottle separating position between upper portions of the bottles in the two rows and which is arranged to provide a double thickness of the wrapper material between the bottle areas which would otherwise be in contact. The bottles in the rows are restrained against endwise movement in the tubular wrapper by engaging heel portions in apertures provided at the juncture of the side and bottom wall panels and separated in the rows by tab separator elements upstanding from the bottom wall panels.

4 Claims, 5 Drawing Figures

BOTTLE PACKAGE

The invention relates to packaging and is more particularly concerned with improvements in carrier type packages of beverage bottles or similar products which employ a single flat blank wrapped about a group of the bottles arranged in longitudinal and transverse row alignment so as to form a tubular container with provision for confining the bottles and separating the bottles so as to meet the requirements for railway shipment while employing the wrapping material in the most economical manner.

In the packaging of bottled and canned beverages two types of carton or carrier structures have achieved extensive use in the beverage marketing industry, namely, the cellular basket-type, which is particularly adaptable for multi-trip use with products in returnable bottles, and the single trip, disposable, wraparound type, which is designed mostly to be employed with products in non-returnable containers, particularly, canned beverages. With the introduction of the disposable beverage bottles the wraparound type has been adapted for these, also, since it employs less material and is more economical for one-trip, disposable use than the basket type. While the separation of the bottles presents no real problem in the basket-type package which is readily designed with separate cells for each bottle, the railway shipping requirements for separation of the bottles, which are breakable, present difficulties in the design of the wraparound type package. Because of its one trip life, economy of materials becomes an important factor. It is a general object of the invention, therefore, to provide a wraparound type bottle package with a bottle separation arrangement which will comply with railway shipping requirements while holding the amount of material employed to a minimum so as to make the package acceptable to economy minded users.

It is a more specific object of the invention to provide a bottle packaging arrangement which employs a single blank for enveloping a cluster of bottles arranged in double row relation with provision for separation of the bottles in the two rows by an interposed section of the blank which is derived from material at one end of the blank in a manner resulting in a highly efficient and effective use of the blank material.

It is a further object of the invention to provide a wraparound type carrier package for beverage bottles, or similar products wherein the bottles are arranged in double row relation and enveloped in a one piece blank of paperboard or similar material with provision for connecting overlapped end portions of the blank in bottom forming relation beneath the bottles by interengaging locking elements therein so as to form a tube about the bottles and with provision for incorporating in the bottom wall partition forming members which are hinged upwardly so as to be disposed between the rows of bottles, with the uppermost portion having a double thickness of material which engages between opposed bottle surfaces at a point of maximum bottle diameter.

Another object of the invention is to provide a wraparound type bottle package which employs a minimum thickness wrapper blank of paperboard or similar foldable sheet material, wrapped about a double row assembly of transversely paired bottles with provisions for restraining the bottles from movement out of the tubular wrapper thus formed and with special provisions for separating the bottles in the rows at a height and thickness of separating material which will satisfy the requirements for railway shipping.

To this end the invention as claimed herein is embodied in a package which employs a single blank of paperboard or other suitable foldable sheet or web material which is cut and scored so as to enable it to be wrapped about a group of bottles arranged in double row, transversely paired and longitudinal alignment, with heel engaging means for retaining the bottles in position in the bottom of the tubular container formed by the wrapper and with cap engaging apertures and narrow end panels at the top for retaining the bottles in position at the top, and a bottle separating partition member in the form of a panel cut in part from a bottom wall panel and in part from the panel area between apertures therein which cooperate with locking fingers in the associated bottom wall panel and which is folded upwardly into a vertical plane in the interior of the tubular container or carton and between oppositely disposed portions of transversely aligned bottles in the two rows thereof with the uppermost portion along the top margin folded upon itself and providing a double thickness of material so as to afford the required separation between the bottles.

The aforesaid objects and other objects and advantages of the invention will become more apparent when reference is made to the accompanying detailed description of the preferred embodiment of the invention which is set forth therein, by way of example, and shown in the accompanying drawings wherein like reference numerals indicate corresponding parts throughout.

Figure 1:
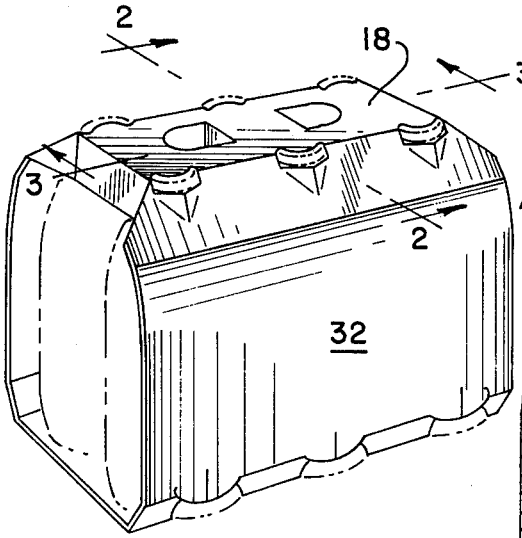
FIG. 1 is a perspective view of a set-up bottle carrier type container, with bottles shown therein in phantom lines, which embodies the principles of the invention.
Figure 2:
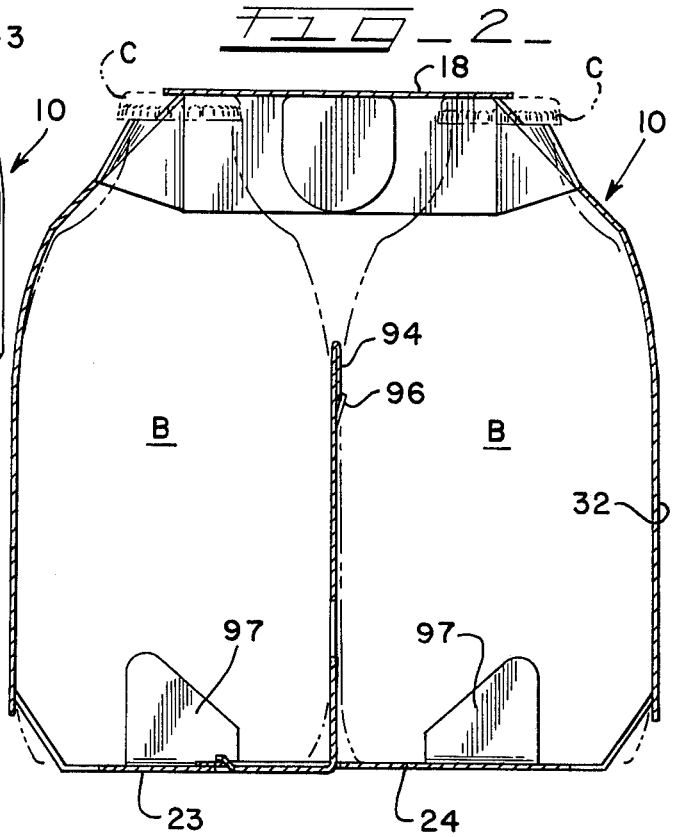
FIG. 2 is a cross sectional view taken on the line 2—2 of FIG. 1, to a larger scale.

Referring to the drawings, there is illustrated a carrier carton for a six bottle package and a cut and scored blank of paperboard, or similar foldable sheet material, for making the same, which embodies the principal features of the invention. It will be understood that the principles of the invention may be otherwise applied and that the following description of the carrier and carton structure as shown in the drawings is for the purpose of setting forth the form of the invention which is presently preferred.

Figure 3:
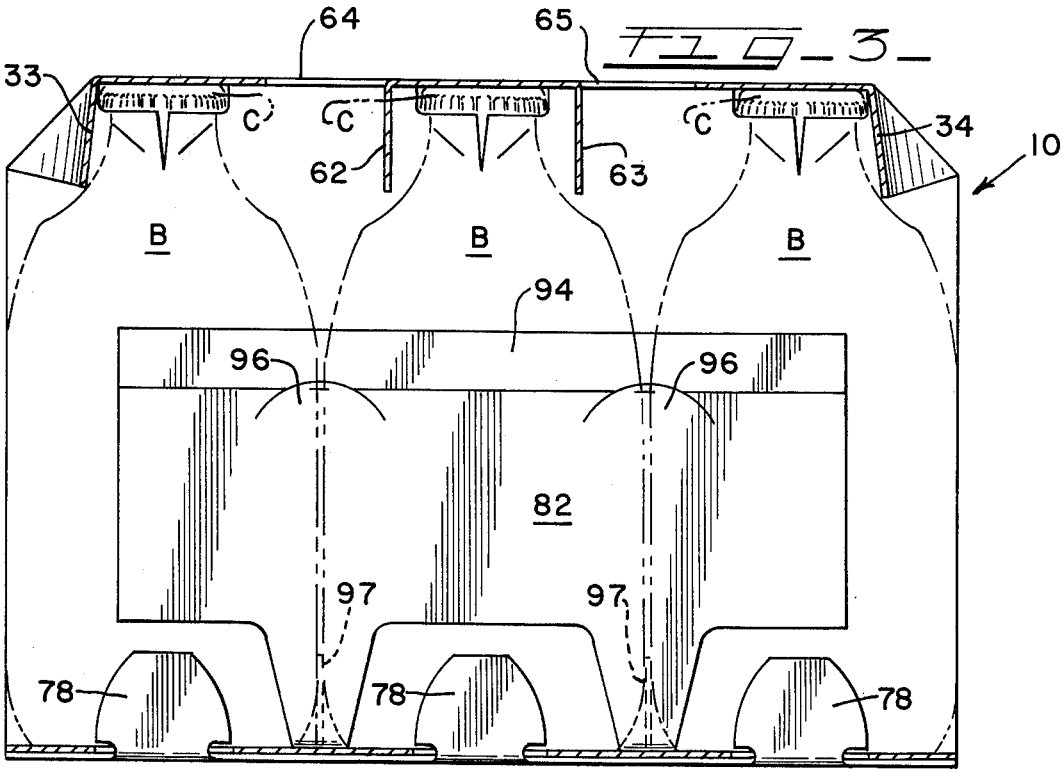
FIG. 3 is a longitudinal section taken on the line 3—3 of FIG. 1 to a larger scale.
Figure 5:
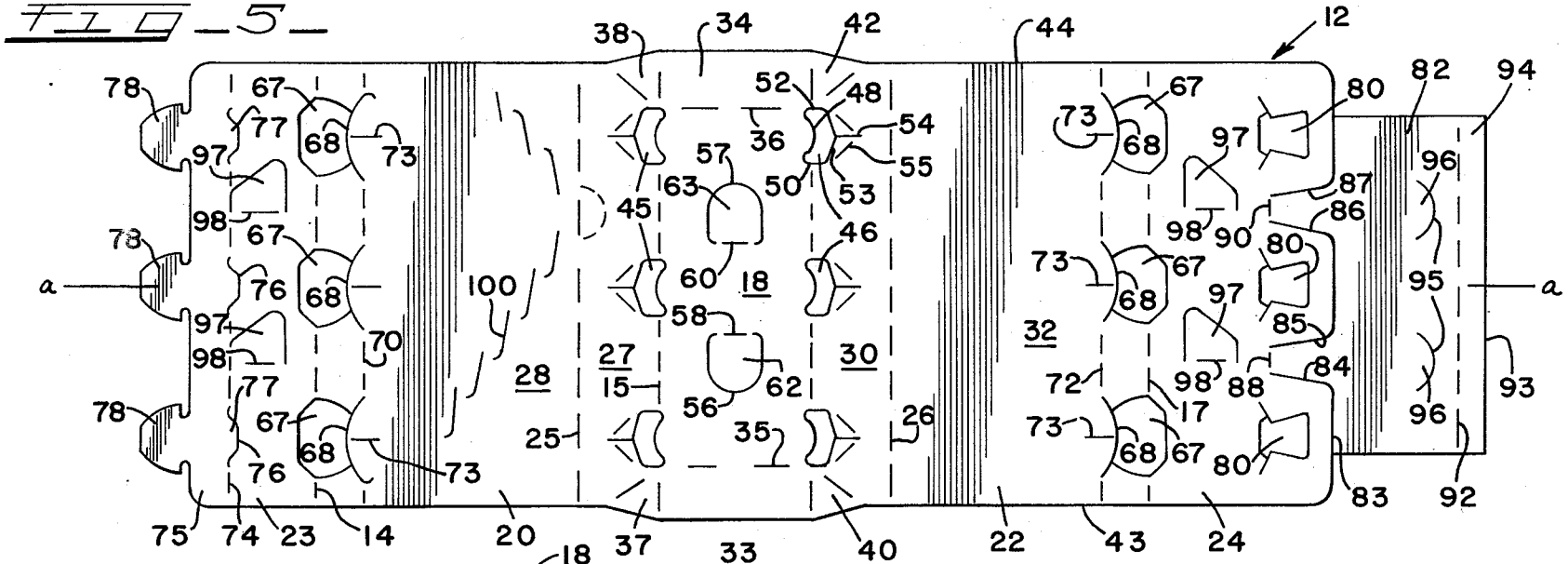
FIG. 5 is a plan view of a cut and scored blank for wrapping about a cluster of bottles to form the container and package illustrated in FIG. 1.
Figure 4:
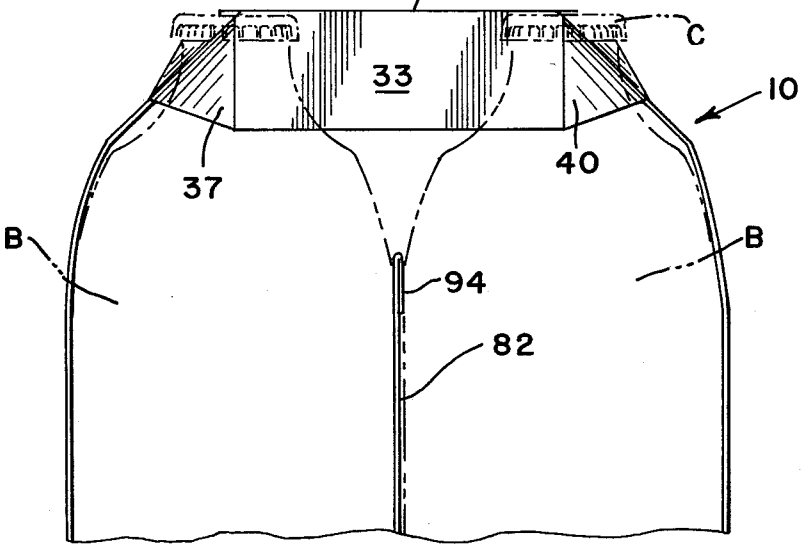
FIG. 4 is a partial end view of the package of FIG. 1, to a larger scale.

The carton structure 10 which is illustrated in FIGS. 1 to 4 is formed by wrapping the blank 12 of FIG. 5 about a cluster of beverage bottles B which are arranged in two rows of three bottles each with the bottles in transversely paired alignment. The blank 12 is paperboard or other suitable foldable sheet material which is cut and scored as shown in FIG. 5. The blank 12, which is to a large extent symmetrical about a longitudinally extending center line *a—a*, is divided by parallel, longitudinally spaced score lines 14, 15, 16 and 17, which extend transversely of the blank, into a top wall forming center panel section 18, adjoining side wall forming panel sections 20 and 22 and bottom wall forming panel sections 23 and 24, the last mentioned being at opposite end margins of the blank 12. The side wall forming panel sections 20 and 22 are subdivided by transversely extending score lines 25 and 26, which are parallel with and equally spaced from the score lines 15 and 16, into associated top and bottom side wall forming panels 27, 28 and 30, 32, respectively. The dimension of the top wall forming panel section 18 in the direction longitudinally of the blank, that is, between score lines 15 and 16, corresponds approximately to the distance between the vertical axes of a pair of transversely aligned bottles B, which distance is less than the transverse distance at the bottom of the bottles, with the result that the top side wall panels 27 and 30 and top portions of side wall panels 28 and 32 are slanted toward each other when the wrapper is assembled with a group of bottles and drawn tight about the same, the score lines 25 and 26 being located so that the panel portions on either side thereof follow generally or generally conform to the upward slant of the bottle surfaces at the upper portions of the bottles, that is, the portions extending from the main portion of bottle body upwardly along the neck portion thereof. The width or transverse dimension of the major portion of the blank 12 corresponds approximately to the bottom dimension of the rows of bottles B, when grouped as shown in FIG. 3, so that when the wrapper 12 is wrapped about the group of bottles, it takes the form of an open ended tube with provision for restraining the bottles against removal out of the ends of the tube.

The restraining means for the top of the endmost bottles comprises relatively narrow panels 33 and 34 formed in opposite side margins of the blank 12 and extending from the opposite ends of the top wall forming panel 18. The panels 33 and 34 are separated from the panel 18 by longitudinally extending hinge or fold forming score lines 35 and 36 with the opposite ends of the panels joined to the adjoining side wall panels 27 and 30 by foldable, triangular webs 37, 38 and 40, 42 which in the set-up carton or carrier are folded so as to lie along or adjacent to inside surfaces of the side wall forming panels, as shown in FIGS. 1 to 4. The top end wall panels 33 and 34 project a short distance beyond the longitudinally extending side edges 43 and 44 of the blank 12 and extend inwardly thereof a similar distance to the score lines 35 and 36, as viewed in FIG. 5.

The top wall forming panel 18 and the adjoining side wall panels 27 and 30 are cut to provide a series of apertures 45 and 46, (FIGS. 1 to 4) which are transversely spaced along opposite side edges of the panel 18 and interrupt the hinge forming score lines 15 and 16, for receiving portions of the bottle caps C on the tops of the bottle B when the package is formed. The apertures 45 and 46, which extend into the side wall forming panels 27 and 30 are of identical configuration and are spaced transversely of the blank in accordance with the spacing of the bottles in the lengthwise rows. The edges 47 of the apertures 45 and 46 are defined by cutting lines 48 which bulge or bow into the apertures 67 in opposite directions away from panel 18, forming small tabs, terminating at their ends at a juncture with short, longitudinal cutting lines 50, 52 which extend to a cutting line 53 which is split by a short, longitudinal cutting line 54 and the area alongside of the same is weakened by small cuts 55. The panel 18 is cut on oppositely directed, C-shaped lines 56, 57 and scored on the lines 58, 60 to provide transversely spaced, hinged tabs 62, 63 which are adapted to be folded into the carrier so as to provide finger holes 64, 65 (FIG. 3) for gripping the package in order to carry the same.

The side wall forming panels 28 and 32 are provided with a series of transversely spaced apertures 67 of identical configuration which are spaced transversely of the blank in accordance with the spacing of the bottles in the lengthwise rows. The apertures 67 interrupt the bottom fold or hinge forming score lines 14 and 17 and extend a short distance into the bottom wall forming panels 23 and 24. The uppermost edges of the apertures 67 in the set up carton are defined by curved cutting lines 68 which bulge or bow into the apertures 67 and which have their ends connected by transverse fold lines 70 and 72. The latter are spaced toward the center of the blank from the fold lines 14 and 17 and the small side wall sections or tabs thus formed are split by short, longitudinally extending cuts 73. The apertures 67 are adapted to receive the heels of the bottles so as to hold the bottles at the bottom against movement in the tightly wrapped package 10. The apertures 67 and associated elements may be formed in accordance with the disclosure in U.S. Pat. No. 3,589,593, granted to Arthur J. Weiss, on June 29, 1971.

The bottom wall forming panels 23 and 24 at the end margins of the blank 12 are provided with locking and latching means in portions thereof which are adapted to be overlapped and secured beneath the bottom of the bottle assembly in wrapping the blank about the assembly so as to form the package 10. The panel 23 which is outermost, when marginal portions of the panels 23 and 24 are overlapped to form the carrier bottom is scored on a transverse line 74 to provide a relatively narrow male locking panel 75 on the blank end margin. The score line 74 is spaced from the end edge of the blank and is interrupted by a series of transversely spaced cutting line formations 76 each extending into the main body of the panel 23 so as to provide locking tab members 77. A series of latching fingers 78, having enlarged heads and reduced neck portions, are formed on the blank end margin in alignment with the locking tab members 77. The other bottom wall forming panel 24, which serves as the female locking panel, is provided with a series of locking apertures 80 for receiving the locking tabs 77 and the latching fingers 78. The locking apertures 80 are transversely spaced in accordance with the spacing of the locking and latching elements 77 and 78 so as to co-operate therewith in securing the panels 23 and 24. The locking and latching arrangement may be the same as the corresponding arrangement described in aforesaid U.S. Pat. No. 3,589,593 or as described in U.S. Pat. Nos. 3,556,386, granted to Robert H. Ganz, on Jan. 19, 1971.

The bottom wall forming panel 24, which constitutes the female locking panel, has an end extension panel 82 which may be of lesser transverse dimension than the major portion or wall forming portion of the blank 12. The panel 82 is provided to serve as a divider between the bottles B in the row rows thereof, as shown in FIG. 3, and the transverse dimension will be somewhat greater than the distance between the vertical axes of the end bottles in the rows. The panel 82 is cut on the transverse line 83 which is interrupted by two pairs of transversely spaced cutting lines 84, 85 and 86, 87 which are spaced between the center locking aperture 80 and the two outside locking apertures and which extend to transversely aligned, hinge forming score lines 88 and 90. The hinge lines 88 and 90 are disposed in transverse alignment and approach a transverse line coinciding with aligned inner edges of the locking apertures so that the panel 82 may be swung into a plane normal to the plane of the bottom wall panel 24 and in approximately centered relation to opposite side edges of the bottom wall which is formed by the panels 23 and 24 when the blank is secured about a double row assembly of bottles. A transverse score line 92 is spaced a short distance from the free end edge 93 of the extension panel 82 and divides the margin so as to form a narrow panel 94 which is adapted to be folded on the hinge line 92 thereby to provide a double thickness of material at the end margin of the panel 82. A pair of transversely spaced, C-shaped cuts 95 are spaced inwardly of the hinge line 92 so as to form a pair of holding tabs 96 for locking the panel 94 in double thickness forming position as shown in FIG. 3. The panel 82 has an over-all dimension longitudinally of the blank which depends upon the configuration of the bottles so as to dispose the margin with the turned over edge panel 94 at the proper height to fall between the maximum diameter portions of the upper sections of the bottle body.

The bottom wall forming panels 23 and 24 have pairs of bottle separating tabs 97 cut therein which hinge about longitudinally extending score lines 98, the latter being transversely spaced according to the spacing of the bottles in the rows and of a size and configuration to hinge upwardly for disposition as separators between the bottles at the bottoms thereof. The bottles are spaced apart at the top in the direction longitudinally of the package by engagement of the tops thereof in the apertures 45, 46 in the side wall panel portions 28, 30 which apertures are spaced apart slightly more than the bottle diameter so as to prevent bottle contact at all four points.

The one side wall forming panel section 20 is provided with a conventional tear out arrangement indicated at 100 to facilitate opening the carrier for access to the bottles.

The manner in which the cut and scored blank 12 is applied to the group or assembly of bottles B will be readily apparent from the drawings and the foregoing description. The blanks are adapted to be fed down onto the tops of the bottle clusters and the side wall panels turned down along the outside faces of the bottles after which the bottom wall forming panels are turned inwardly with the separating panel 82 and tabs 97 hinged to a position to be guided between the bottles. The edge panel 94 may be folded back and secured by the holding tabs 96 when the blank is fabricated or prior to the folding of the panels 23 and 82. The panels 23 and 24 are secured by inte.engaging the locking tabs 77 and latching fingers 78 on the outermost panel 23 in the co-operating apertures 80 in the innermost marginal portion of the panel 24. The latching fingers 78 may be positioned in upstanding relation to the bottom wall panels where they are disposed between transversely paired bottles and serve as separators.

The arrangement of the panel 82 in the manner illustrated enables the blank to be held to a minimum length while the turned over top edge portion 94 provides the thickness of material required to comply with railway shipping requirements and permits the use of board having a thickness which is sufficient for use in this type package and which affords sufficient economy to compete with other throwaway or disposable, one-trip type carrier packages.

I claim:

1. An elongate blank of foldable sheet material cut and scored for wrapping about a group of articles in the form of bottles arranged in double row, transversely paired relation, so as to enclose the articles in a tubular container, said blank being divided by longitudinally spaced, transverse score lines into a top wall forming panel adapted to be positioned on the tops of the articles, adjoining side wall forming panels adapted to be positioned on the outermost sides of the articles and end panels adapted to be connected beneath the articles so as to form a bottom wall, the score lines separating the top wall forming panel from the adjoining side wall forming panels being interrupted by transversely spaced apertures adapted for receiving top portions of the articles, the bottom wall forming panels and the adjoining side wall forming panels having apertures spaced transversely of the blank which interrupt the score lines separating the same and which are formed for receiving bottom portions of the articles, one of said bottom wall forming end panels having transversely spaced locking tab members and longitudinally aligned latching fingers arranged in paired relation with the tab member and latching finger of each pair thereof being spaced longitudinally of the blank, and the other one of said bottom wall forming end panels having transversely spaced locking apertures in which said locking tabs and latching fingers are engaged when the container is formed, said locking apertures each being aligned longitudinally of the blank with a pair of the locking tab and latching finger members and having a dimension longitudinally of the blank which enables the locking tab and the associated latching finger to be engaged therein, said blank having a panel forming an extension of the end panel in which said transversely spaced apertures are located, which extension panel is separated from the bottom wall forming portion of the associated end panel on a cutting line having portions thereof extending transversely of the blank and adjoining portions extending in a generally longitudinal direction which are in paired spaced relation and disposed between the portions of said end panel in which said apertures are located, the longitudinal portions of each pair of said cutting line portions terminating at opposite ends of hinge forming score lines which extend between said longitudinal cutting line portions and which are aligned transversely of the blank so as to provide a hinge connection for said partition panel, said hinge forming score lines being spaced from the transverse edge of said apertured portions of said end panel which are defined by the transversely extending portions of said cutting line, whereby said longitudinal partition forming panel is derived in part from the adjoining bottom wall forming end panel, and said longitudinal partition forming panel having an overall dimension in the direction longitudinally of the blank and extending from said hinge forming score lines which is greater than the corresponding dimension of the apertured portions of said end panel and which is less than the height of said articles, said dimension being sufficient, when said partition forming panel is hinged to an upstanding position between the two rows of articles in the container, to separate otherwise contacting portions of the articles and to provide for holding the rows of articles in non-contacting, separated relation.

2. A package comprising a group of articles in the form of bottles arranged in double row, transversely paired relation and enclosed in a tubular container formed by wrapping a single blank of foldable sheet material about the group of bottles, said container comprising a top wall forming panel overlying the tops of said bottles in the two rows thereof, adjoining side wall forming panels extending down along the outermost sides of said bottles and bottom wall forming panels having their margins overlapped and connected by interengaging locking and latching elements, means at the juncture of said top wall forming panel and said adjoining side wall forming panels for holding the top portions of said bottles against movement in the direction of the ends of the tubular container and means at the juncture of said bottom wall forming panels and said side wall forming panels for holding the bottom portions of the bottles against movement in the direction of the ends of the tubular container, and said bottom wall panels having an associated, hingedly connected, bottle separating panel disposed in upstanding relation between the rows of bottles which separating panel is of sufficient dimensions to extend to a point above the center portions of the bottles and to provide a center longitudinal partition for holding the rows of bottles in non-contacting, separated relation, said upstanding separating panel having a double thickness portion at the top margin which is provided by folding over a marginal strip portion and securing the same to adjoining portions of said panel by latching tab members cut from said panel and having free edge portions positioned to overlie the margin at the free edge of said marginal strip portion.

3. A package comprising a group of articles in the form of bottles arranged in double row, transversely paired relation and enclosed in a tubular container comprising a single blank of foldable sheet material wrapped about the group of bottles, said container having a top wall forming panel overlying the tops of said bottles in the two rows thereof, adjoining side wall forming panels extending down along the outermost sides of said bottles and bottom wall forming panels extending inwardly of a hinged connection with the bottom edges of said side wall forming panels having marginal portions which are overlapped and connected by interengaging male and female locking and latching means, said interengaging male and female locking and latching means comprising spaced apertures in one of said bottom wall forming panels and locking tabs and latching fingers on the associated bottom wall forming panel which are engaged in said apertures, means at the juncture of said top wall forming panel and said adjoining side wall forming panels for holding the top portions of said bottles against movement in the direction of the ends of the tubular container and means at the juncture of said bottom wall forming panels and said side wall forming panels for holding the bottom portions of said bottles against movement in the direction of the ends of the tubular container, and a bottle separating panel disposed in upstanding relation between the rows of bottles which separating panel is of sufficient vertical dimension to extend between otherwise contacting portions of the bottles so as to provide a center longitudinal partition of a height which will hold the bottles in the rows in non-contacting, separated relation, said upstanding separating panel having a hinged connection with a bottom wall forming panel and portions of said bottom wall forming panel locking and latching means being taken at least in part from said bottle separating panel, said article separating panel being disposed in upstanding position in a plane extending between said rows of articles with the hinged connection between said separating panel and said bottom wall forming panel extending between panel portions in which said apertures are located, the associated locking tabs being disposed beneath the articles in the one row thereof which is positioned between the hinged connection of said article separating panel with its associated bottom wall forming panel and the hinged connection of the cooperating bottom wall forming panel with its associated side wall panel and the latching fingers being disposed in upstanding relation between the transversely paired bottles and substantially in the plane of said upstanding article separating panel.

4. A package comprising a group of articles in the form of bottles arranged in double row, transversely paired relation and enclosed in a tubular container formed by wrapping a single blank of foldable sheet material about the group of bottles, said container comprising a top wall forming panel overlying the tops of said bottles in the two rows thereof, adjoining side wall forming panels extending down along the outermost sides of said bottles and bottom wall forming panels hinged to the bottom edges of said side wall forming panels and extending inwardly beneath the bottles, said bottom wall forming panels having portions overlapped and connected by interengaging locking and latching means which comprise male and female elements, means at the juncture of said top wall forming panel and said adjoining side wall forming panels for holding the top portions of said bottles against movement in the direction of the ends of the tubular container and means at the juncture of said bottom wall forming panels and said side wall forming panels for holding the bottom portions of the bottles against movement in the direction of the ends of the tubular container, and a bottle separating panel disposed in upstanding relation between the rows of bottles which separating panel is of sufficient vertical dimension to extend upwardly between the bottles in the two rows thereof to a point short of the top of the bottles where, in the absence of the partition, there would be topmost contact between the confronting portions of the bottle surfaces, whereby said partition will serve to hold in separated, non-contacting relation throughout the height thereof the bottle surface portions which would otherwise be contacting each other, said upstanding bottle separating panel being integrally hinged to the bottom forming panel and constituting an extension thereof, said bottom forming panel having portions spaced along the free edge thereof in which there are apertures constituting said female locking and latching elements, said bottle separating panel being integrally hinged to said bottom wall forming panel on hinge lines which extend between said apertured panel portions and which are spaced a substantial distance from the free edges of said apertured panel portions whereby said bottle separating panel is positioned in upstanding relation between the two rows of bottles and said apertured panel portions extend in the plane of the associated bottom wall forming panel and are interengaged in locking relation with said male locking and latching elements.

* * * * *